US006520824B1

(12) United States Patent
Caroselli

(10) Patent No.: US 6,520,824 B1
(45) Date of Patent: Feb. 18, 2003

(54) BALLOON TOY VEHICLE

(75) Inventor: Rom Caroselli, Scottsdale, AZ (US)

(73) Assignee: Toytronix, Scottsdale, AZ (US)

( * ) Notice: Subject to any disclaimer, the term of this patent is extended or adjusted under 35 U.S.C. 154(b) by 54 days.

(21) Appl. No.: 09/662,714

(22) Filed: Jun. 13, 2000

Related U.S. Application Data

(63) Continuation-in-part of application No. 09/406,133, filed on Sep. 27, 1999, now abandoned.

(51) Int. Cl.[7] ..... A63H 27/00
(52) U.S. Cl. ..... 446/58; 446/225; 446/454
(58) Field of Search ..... 446/1, 30, 33, 446/34, 57, 58, 68, 211, 220, 225, 454

(56) References Cited

U.S. PATENT DOCUMENTS 1,403,595 A * 1/1922 Dykas ..... 446/30
2,081,381 A * 10/1934 Oehmichen ..... 244/26
3,119,611 A * 1/1964 Bennett ..... 472/9
4,729,750 A * 3/1988 Prusman ..... 446/225
4,891,029 A * 1/1990 Hutchinson ..... 446/58
4,931,028 A * 6/1990 Jaeger et al. ..... 446/225
5,368,256 A * 11/1994 Kalisz et al. ..... 244/26
5,449,129 A * 9/1995 Carlile et al. ..... 244/26
5,694,153 A * 12/1997 Aoyagi et al. ..... 345/161
6,010,093 A * 1/2000 Paulson ..... 244/24

* cited by examiner

*Primary Examiner*—Jacob K. Ackun
*Assistant Examiner*—Faye Francis
(74) *Attorney, Agent, or Firm*—Jonathan Grant; Grant Patent Services

(57) ABSTRACT

A balloon toy vehicle is disclosed which has full direction control, altitude control and a motorized release feature that permits an object to be lifted and dropped remotely. Fixed tandem reversible thruster motors are positioned approximately perpendicular to the gondola body of the vehicle and work in tandem to provide forward, reverse, left turn and right turn movements. A third thruster motor is positioned along the length of the gondola body facing downward to provide lift. In a preferred embodiment, the lift thruster motor, is positioned slightly angularly from a vertical longitudinal plane passing through the gondola body and is attached to the gondola body by a bracket. This motor arrangement gives the vehicle both lift and anti-spin stability. An adjustment feature is provided to set the gondola body in a horizontal plane. This accommodates any variations in the fixed balloon connection. The vehicle is preferably operated by wireless remote control.

18 Claims, 9 Drawing Sheets

BALLOON TOY VEHICLE

The following is a continuation in part of U.S. patent application Ser. No. 09/406,133, Sep. 27, 1999 now abandoned.

BACKGROUND OF THE INVENTION

1. Field of the Invention

The present invention discloses a balloon toy vehicle which has fill directional control, altitude control, an anti-spin adjustment and a motorized release feature that permits an object to be lifted and dropped remotely.

2. Description of the Prior Art

In the past, there have been a number of attempts to develop a toy which simulates a dirigible or lighter than air ship.

U.S. Pat. No. 4,891,029 (Hutchinson) discloses a remote control lighter-than-air toy having an inflatable container in the shape of a dirigible. A gondola is removably attached to the inflatable container and has a shaft extending there through and rotatably supported thereon. A reversible electric motor is attached to each end portion of the shaft passing through the gondola with each motor having a propeller attached for rotation upon actuation of the motor. The motors and propellers are rotatably attached to the shaft. A radio receiver is connected to each of the electric motors with a plurality of conductors. A control box has a radio transmitter therein and a plurality of controls thereon for transmitting to said receiver and remotely controlling each motor separately, so that a lighter than air toy can be can be remotely controlled with two propellers.

U.S. Pat. No. 5,906,335 (Thompson) discloses a flight direction control system for blimps, using radio controls. This system is for a full size blimp.

U.S. Pat. No. 5,149,015 (Davis) discloses a radio controlled hot air balloon, particularly suitable for hobbyists, The balloon includes a balloon envelope, a burner assembly, and a radio control system. The altitude of the balloon is remotely controlled by adjusting the amount of hot air produced by the burner assembly.

U.S. Pat. No. 5,429,542 (Britt, Jr.) discloses a helium-filled remote-controlled saucer toy having a central aperture disposed there through, a filling mechanism for allowing the saucer to be filled with helium gas for enabling the saucer to hover in the air, a first fan having a fixed stator coupled within the aperture of the saucer, a rotatable rotor extend upwards therefrom, and fan blades coupled about the rotor for providing a propelling force for moving the saucer upwards or downwards when the rotor is rotated in one direction or in the opposite direction; a second fan having a fixed stator coupled about the rotor for providing a propelling force for spinning the saucer clockwise or counter-clockwise when the rotor is rotated in one direction or in the opposite direction; a receiver mechanism adapted for receiving signals for controlling the direction of rotation of the fan blades; a power mechanism for energizing the fans and receiver mechanism, and a transmitter mechanism for transmitting signals to the receiver mechanism for controlling the fans.

U.S. Pat. No. 4,799,914 (Hutchinson) discloses a remote control lighter-than-air toy with a tether. This toy is similar to U.S. Pat. No. 4,891,029 (see above) except a tether is used instead of a remote control system.

SUMMARY OF THE INVENTION

In the prior art, none of the toy flying devices had three motors. U.S. Pat. No. 4,891,029 (Hutchinson) and U.S. Pat. No. 5,906,335 (Thompson) disclose a flight control system based on active vectoring of the tandem motor arrangement to provide altitude changes. The present invention discloses a fixed tandem motor arrangement which operates independently of a third vertically oriented thruster which does not actively change position. Because of the third vertically oriented motor for altitude control, altitude corrections may be obtained much faster because the response time required to re-position the direction of a motor assembly will be longer than the response time needed to simply change the speed of a third fixed motor. Additionally, the third vertically oriented motor can provide altitude corrections independently of the flight motions produced by the tandem motor set used for forward, reverse, left and right. This also enhances the control capability and allows the aircraft to maintain a fixed hover position with greater ease. By comparison, in the Hutchinson and Thompson disclosures, the forward and reverse motions will usually be coupled with an altitude change. That is, a thrust vector between 0 and 90 degrees from the horizontal will produce both a horizontal and vertical motion. This coupling complicates flight control.

The idea of using a third independently operated thruster to provide both lift and anti-spin is unique. This type of arrangement is unique because ordinarily some secondary thrust vectoring is required to provide anti-spin. For example, helicopters use a tail rotor blade, or re-direct engine thrust out of the tail for anti-spin control. A secondary thrust is provided some distance from the vehicle lift point (the main helicopter rotor) because the lift point is at the main rotor hub. However, in the present invention, the main lift point is the balloon which is positioned some distance form the main rotor. In this configuration, the main rotor is able to provide both a lift and a vectored component necessary for anti-spin.

The proposed three motor system also permits a significant weight reduction in the motor assembly, which means the flight toy size can be reduced. The weight penalty associated with vectoring, as in Hutchinson and Thompson) typically is higher than using a third motor. This is one key feature which directly impacts toy size.

In another embodiment of the invention, the balloon toy permits an object to be remotely picked up, placed, and released in flight.

BRIEF DESCRIPTION OF THE DRAWINGS

The above and other objects, features and advantages of the present invention will become more readily apparent from the following description, reference being made to the accompanying drawings in which.

DETAILED DESCRIPTION OF THE INVENTION

Figure 1:
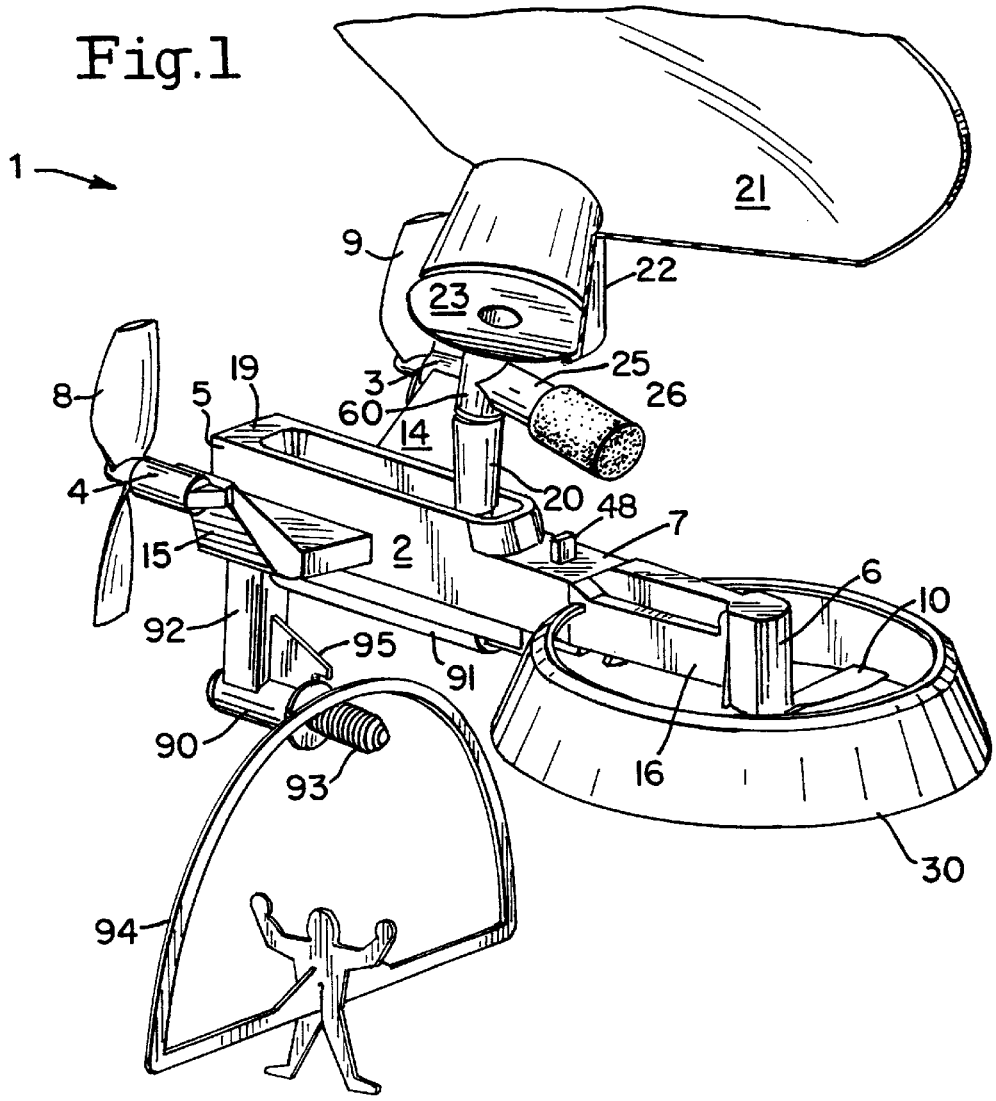
FIG. 1 is a perspective view of the gondola body with balloon attached.
Figure 2:
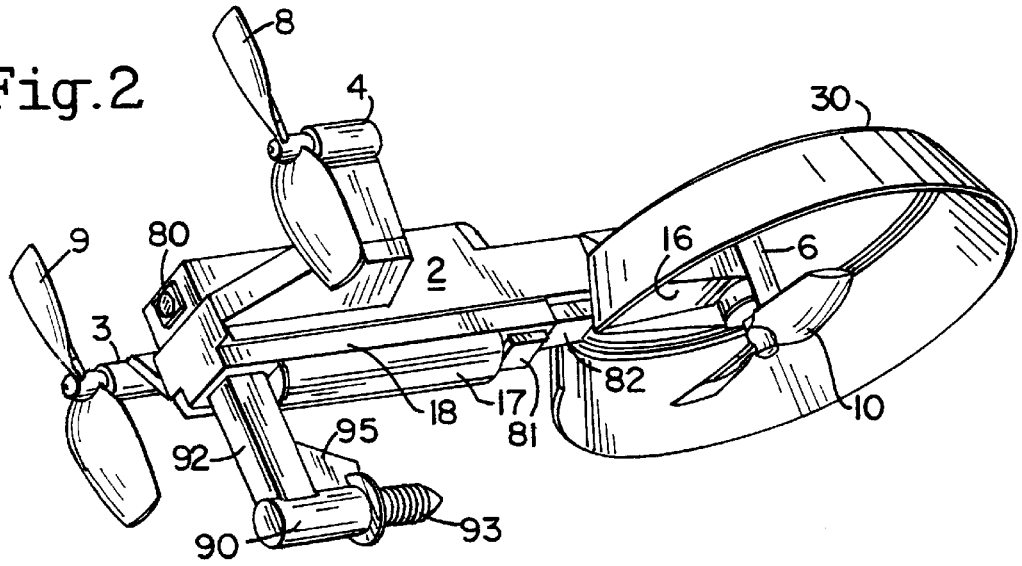
FIG. 2 is a view of the underside of the gondola body.

Referring to FIGS. 1 through 8, the balloon flight toy 1 comprises a gondola body 2 having attached to it fixed tandem motors 3 and 4 at a distal end 5 of the gondola body 2 and a third vertically oriented fixed thruster motor 6 at the proximal end 7 of the gondola body 2. Each of the motors 3, 4, and 6 has attached to it a propeller 8, 9, and 10 facing away from the gondola body, wherein the propellers 8, 9, and 10 are attached to the spindles of the motors. The fixed tandem motors 3 and 4 are positioned approximately perpendicular to the gondola body 2, and approximately parallel with each other. In a preferred embodiment of the invention, it is preferred that the fixed tandem motors 3 and 4 upon which propellers 8 and 9 are attached are themselves attached to the gondola body 2 of the toy by means of brackets 14 and 15, giving the propellers 8 and 9 enough room to rotate without hitting the gondola body 2. The left and right propellers 8 and 9 work in tandem to provide the forward, left, right and reverse movement.

The lift thruster motor 6 is positioned along the length of the gondola body 2 approximately in line with the gondola body 2, and facing downward. In a preferred embodiment, the lift thruster motor 6 is positioned slightly angularly from the side of the gondola body 2 and is attached to the gondola body 2 by a bracket 16. It is preferred that a motor shroud 30 surround the circumference of the path of the propeller 10. In the preferred embodiment of the invention, thruster motor 6 is non-reversible, producing only lift; ballast weights are added to make the flying toy slightly less than buoyant, thereby forcing a gradual descent in the absence of a lift thrust. In another preferred embodiment of the invention, the lift thruster motor 6 is reversible to force the flying toy either up or down from a neutral buoyancy state, while also using ballast weights. The flying toy may preferably include at least one pocket 36 for placing ballast weights need to control buoyancy. In another preferred embodiment of the invention, there is a release motor 90 positioned on the underside 91 of the gondola body 2. The release motor 90 is connected to a bracket 92. Additionally, the release motor 90 is connected to a worm screw 93. External to the device is a lift hoop 94. A guide edge 95 slopes downward away from the bracket 92 and on top of the release motor 90. This guide edge 95 guides the lift hoop down to rest on the worm screw 93, thereby improving the chances of a successful pick up and release. The release motor 90 turns the worm screw 93, which moves the lift hoop down the threads until it falls off the end.

The motors are powered by a battery 17 held in a battery bracket 18. The battery size may vary; however, as weight is a consideration. In a preferred embodiment of the invention, the battery is a common AAA 1.5 volt battery, or a smaller rechargeable 1.2 volt battery.

The top 19 of the gondola body 2 preferably has a balloon mounting assembly 20. This assembly has a place for connecting the balloon 21 to the gondola body 2 of the toy 1. A latex balloon nozzle 22 attaches to a large disk 23 positioned at the top of the assembly 20. The balloon is filled with helium via a port 25 which is sealed with a cap 26 preferably made out of rubber. A shaft 60 supports the disk 23 to which the balloon is attached.

Figure 10:
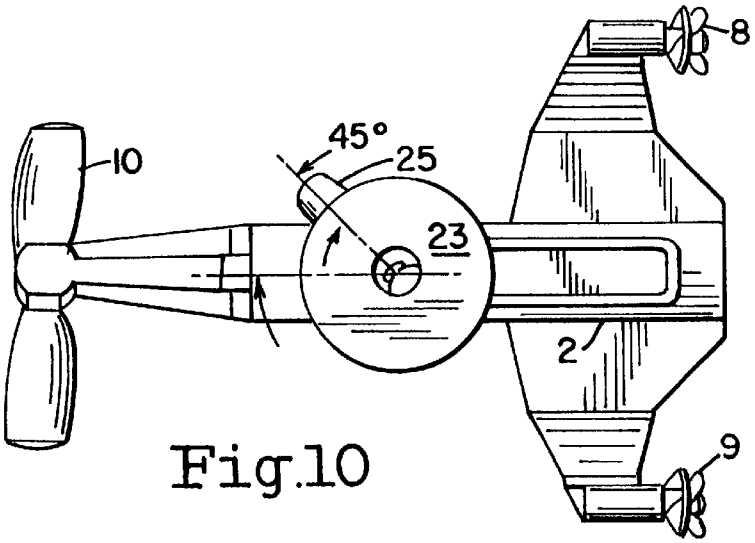
FIG. 10 is an overhead view of the rotatable connector positioned at 45 degrees.
Figure 4:
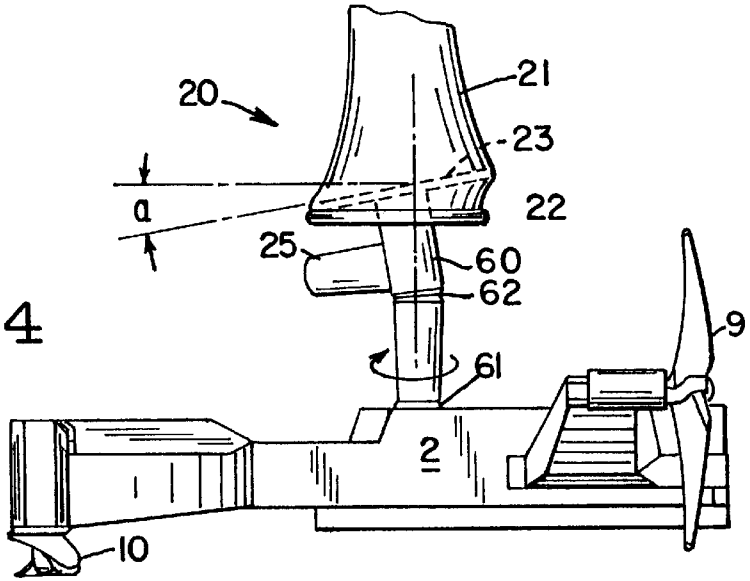
FIG. 4 is a side view of the gondola body and balloon, with the rotatable joint connector positioned at 45 degree for leveling the gondola body.
Figure 11:
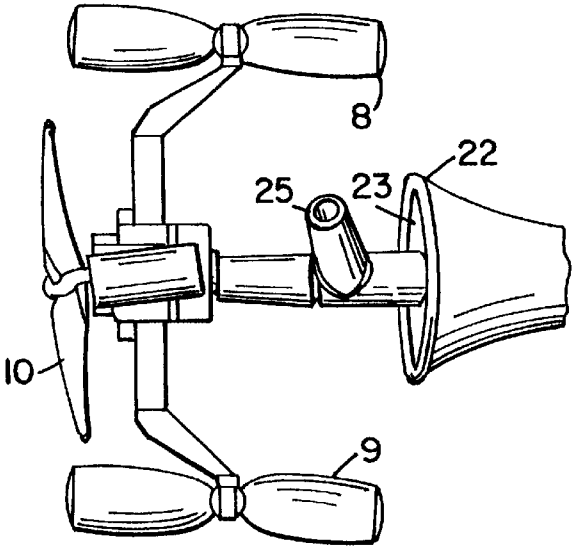
FIG. 11 is a frontal view of the gondola body with the rotatable connector positioned at 45 degrees.
Figure 5:
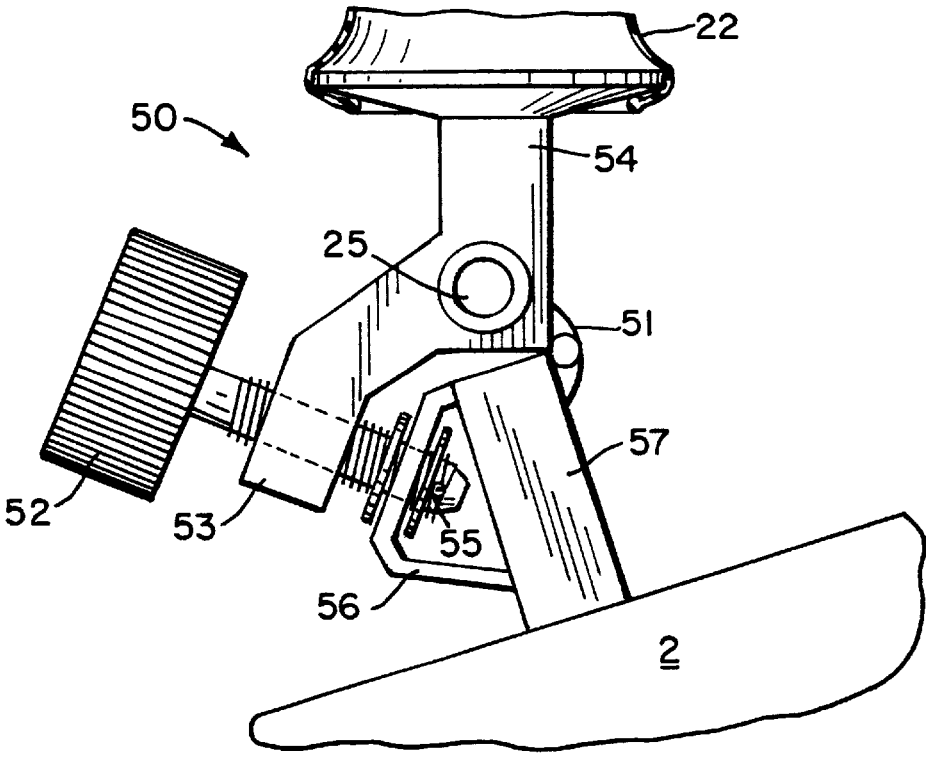
FIG. 5 is a side view of an alternative device for leveling the gondola body.
Figure 6:
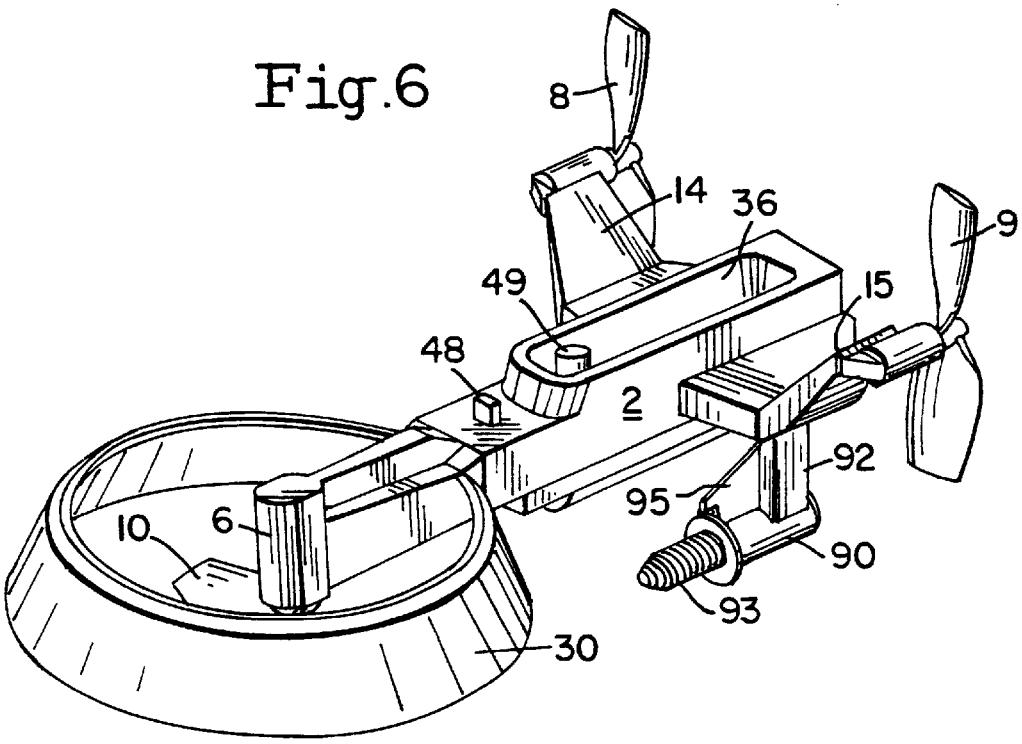
FIG. 6 is a perspective view of the gondola body.
Figure 8:
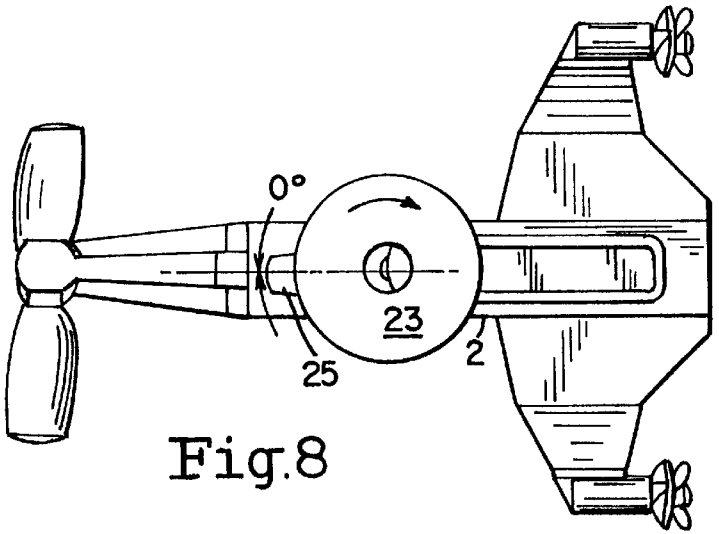
FIG. 8 is an overhead view of the rotatable connector positioned at 0 degrees.
Figure 7:
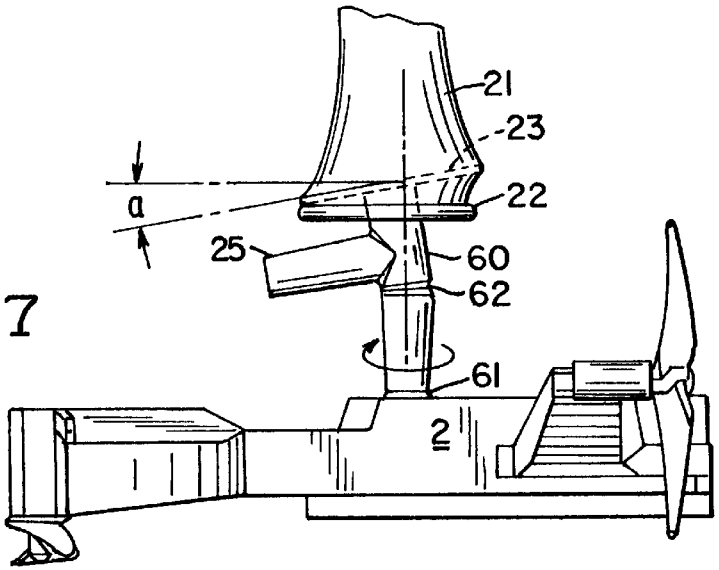
FIG. 7 is a side view of the rotatable joint connector positioned at 0 degrees.
Figure 9:
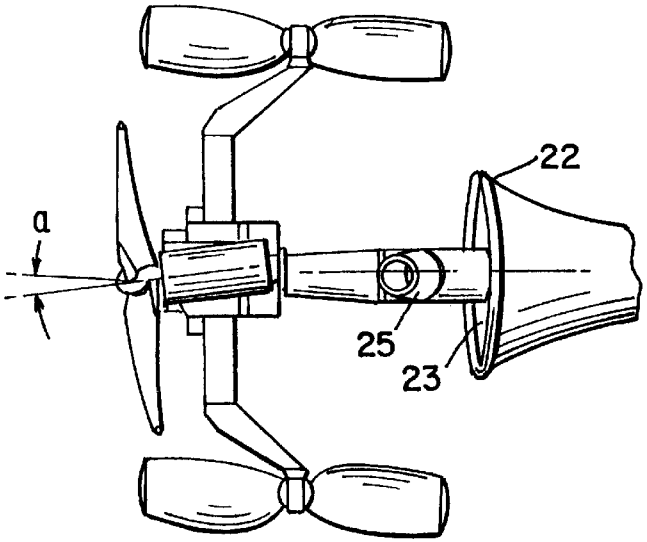
FIG. 9 is a frontal view of the gondola body with the rotatable connector positioned at 0 degrees.
Figure 13:
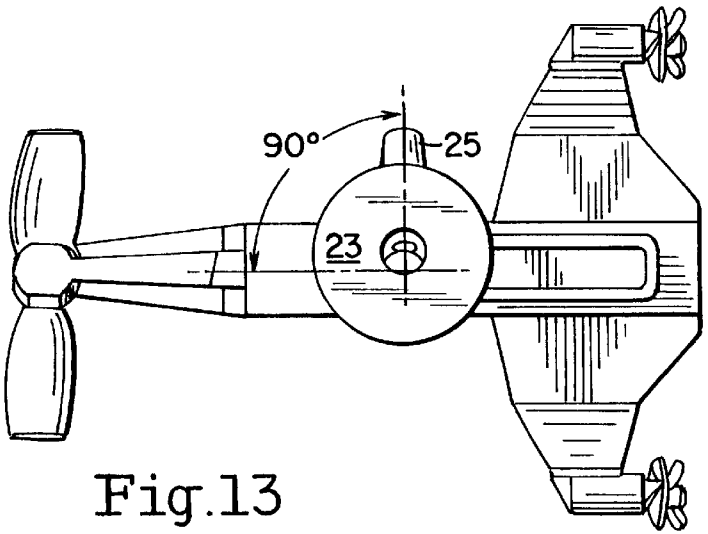
FIG. 13 is an overhead view of the rotatable connector positioned at 90 degrees.
Figure 12:
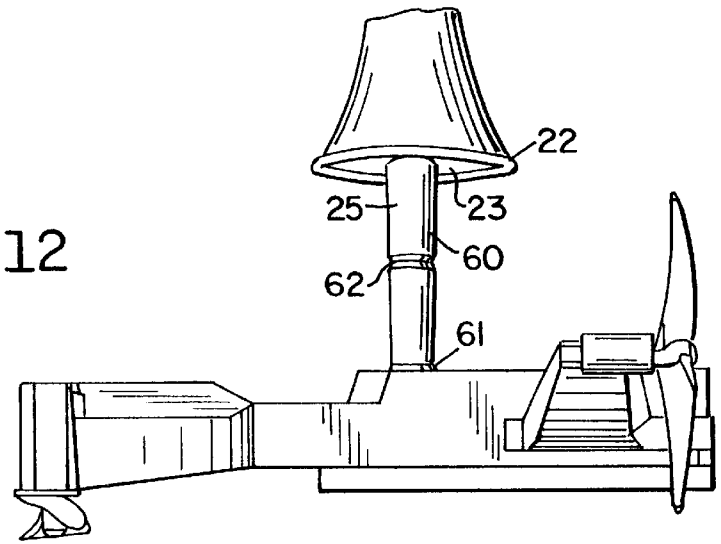
FIG. 12 is a side view of the rotatable connector positioned at 90 degrees.
Figure 14:
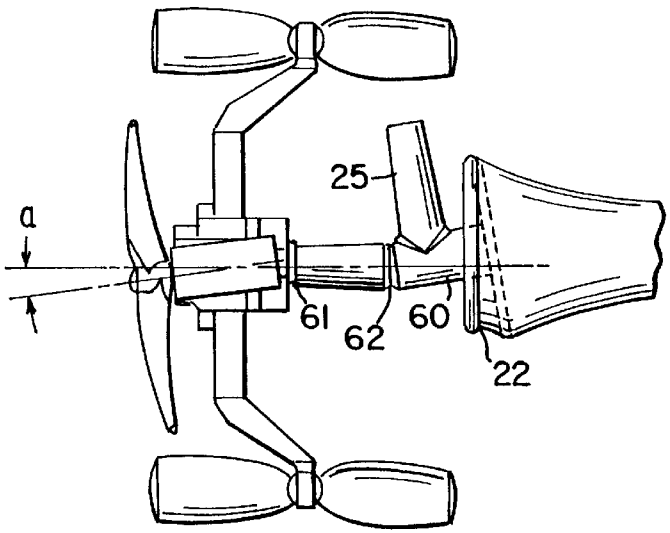
FIG. 14 is a frontal view of the gondola body with the rotatable connector positioned at 90 degrees.
Figure 16:
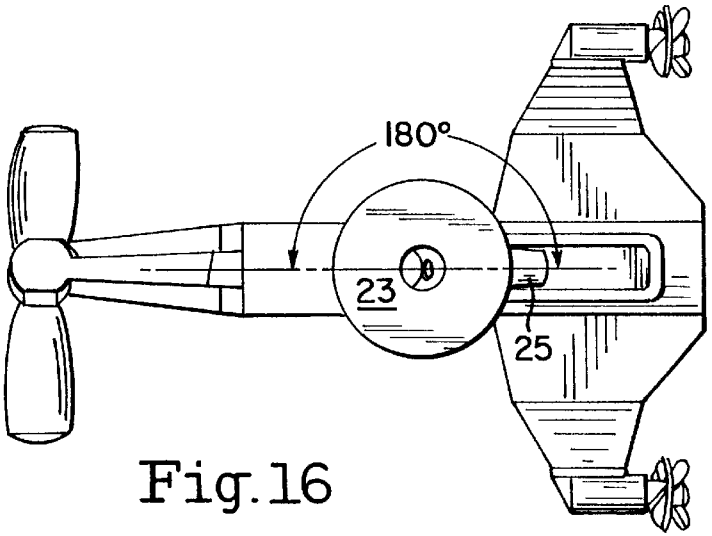
FIG. 16 is an overhead view of the rotatable connector positioned at 180 degrees.
Figure 15:
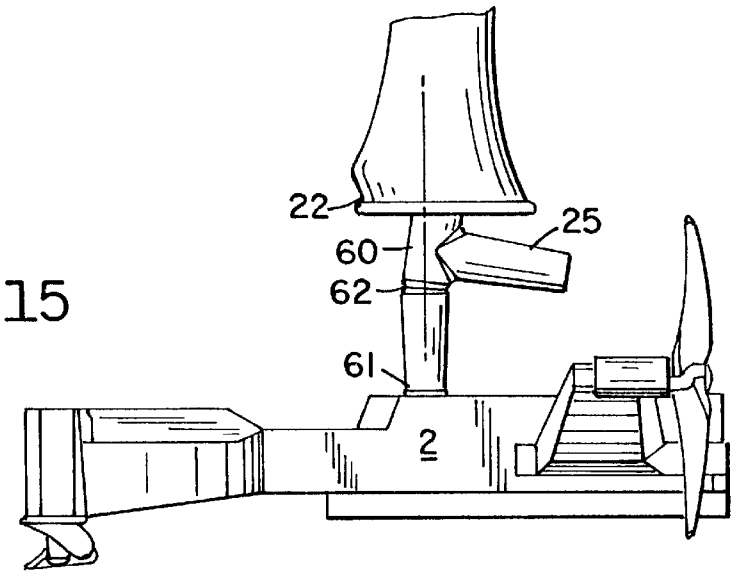
FIG. 15 is a side view of the rotatable connector positioned at 180 degrees.
Figure 17:
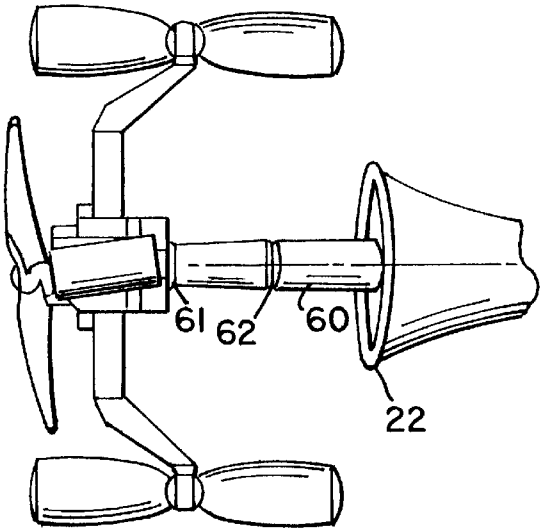
FIG. 17 is a frontal view of the gondola body with the rotatable connector positioned at 180 degrees.
Figure 19:
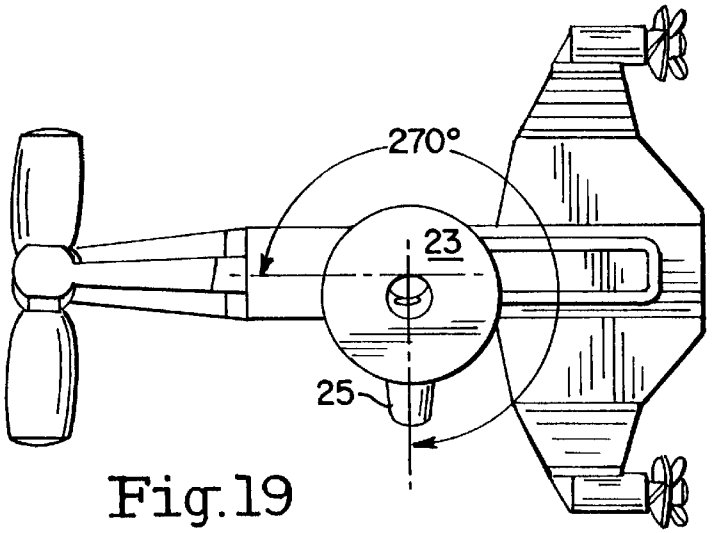
FIG. 19 is an overhead view of the rotatable connector positioned at 270 degrees.
Figure 18:
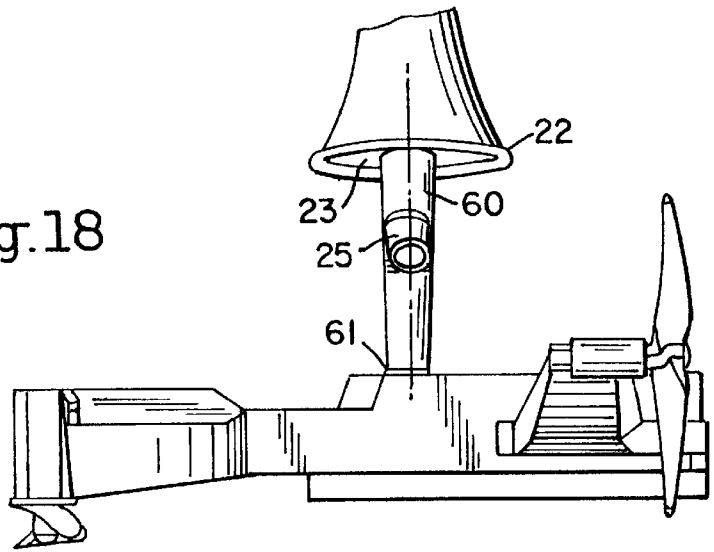
FIG. 18 is a side view of the rotatable connector positioned at 270 degrees.
Figure 20:
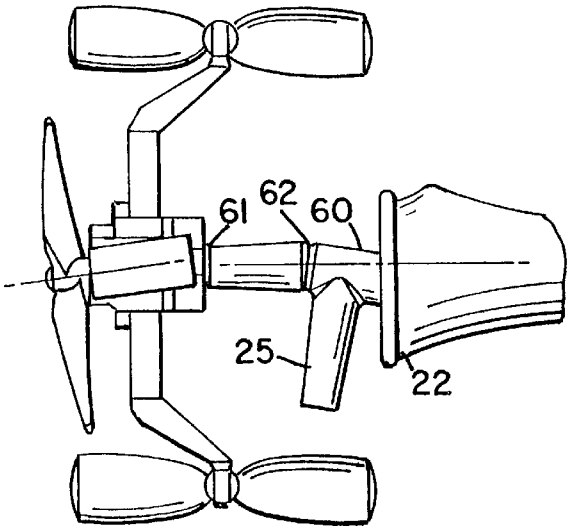
FIG. 20 is a frontal view of the rotatable connector positioned at 270 degrees.

In the preferred embodiment of the invention, the balloon connector assembly 20 which holds the balloon in place is allowed to rotate about the motorcraft gondola body by means of a rotatable joint 61. The shaft 60 has an angular bend 62 along its length. It is this rotation of the shaft and balloon relative to the motorcraft gondola body which adjusts the angular orientation of the gondola body relative to the horizon. FIGS. 4 and 7–20 depict the gondola body in the horizontal plane required for anti-spin control, and the rotation adjustment is shown to mitigate undesired balloon attach misalignment. FIGS. 7, 8, and 9 depict the baseline shaft position at 0 degrees relative to the gondola body. In this position, a balloon with maximum allowable attachment misalignment (front-to-rear) visible in the side view is mitigated, while almost no correction is needed side-to-side as shown in the front view. As the shaft is rotated clockwise from this baseline position, the front-to-rear misalignment mitigation reduces, while the side-to-side misalignment mitigation increases. FIGS. 4, 10 and 11 depict a 45 degree shaft position where some balloon attachment misalignment occurs in both planes (front and side views). FIGS. 12, 13, and 14 depict a 90 degree shaft position where the maximum allowable balloon attachment misalignment occurs from side-to-side as shown in the front view. This is the type of misalignment (side-to-side) which will cause the vertical thruster to tilt out of its prescribed anti-spin angle. Similar complementary types of misalignment mitigation are depicted for 180 degree and 270 degree shaft positions as shown in FIGS. 15 through 20. For misalignments other than the maximum there will be some small complementary forward-to-aft tilt of the gondola body. This small forward-to-aft tilt produces a negligible component of up or down thrust vector from the tandem motors and therefore does not disturb the forward, reverse, left and right control actions. It is important to note that the maximum allowable misalignment to be mitigated is set by the fixed angle in the balloon connector shaft.

In another preferred embodiment of the invention, there may be a different means of adjustment of the angle of the gondola body to make it level with the horizon. The leveling adjuster 50 flexes the hinged connection 51 between the balloon 22 and the gondola 2. A screw 52 is threaded through a bracket 53 connected to the top portion 54 of the connection and the screw end 55 is secured to a second bracket 56 mounted on the lower portion shaft 57 which flexes connection 51 in the amount need to level the gondola body for anti-spin control. This embodiment of the invention has the advantage of not producing undesirable forward-to-aft tilt in the gondola body, but is more complex and heavier than the preceding embodiment of the invention.

Figure 3:
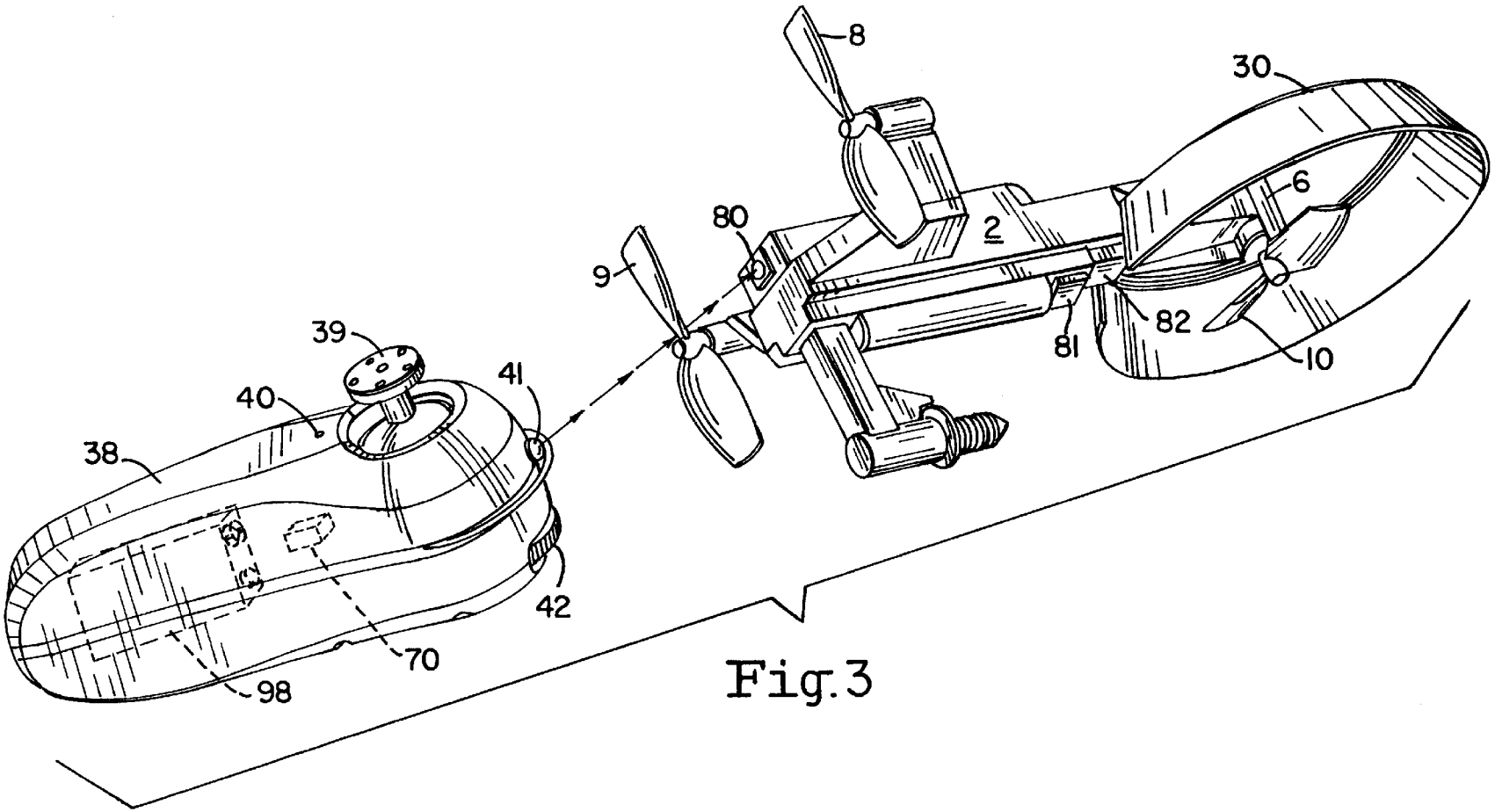
FIG. 3 is a schematic view of the transmitting and receiver control system.
Figure 21:
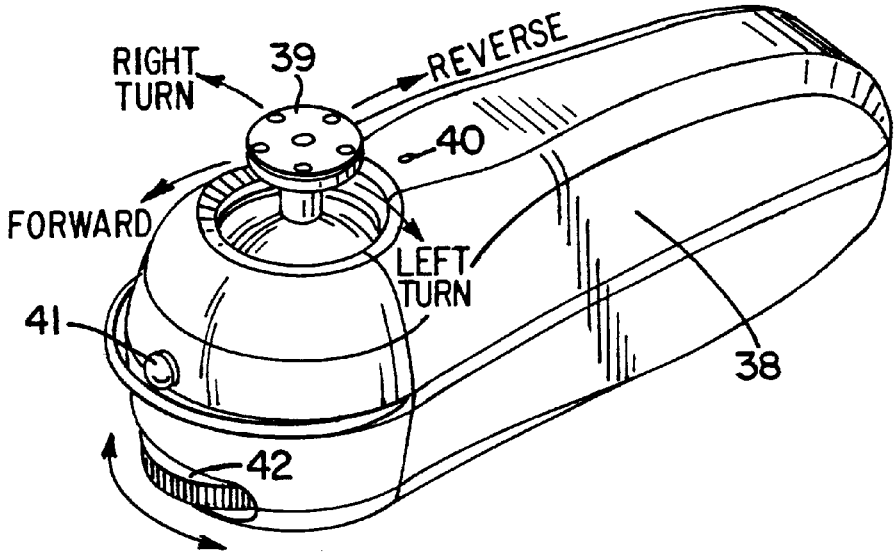
FIG. 21 is a perspective view of the remote controller device.

In a preferred embodiment of the invention, the toy is operated by an infrared remote controller. The remote controller 38 (FIG. 21), in a preferred embodiment, has a joystick 39 which, when moved forward, propels the toy forward, when moved right, propels the toy to turn right, when moved left, propels the toy to turn left, and when moved backwards, propels the toy backwards. There is an indicator light emitting diode 40 on top of the remote controller 38, and an infrared emitter 41 at the front of the control. There is also a potentiometer with a wheel knob 42 to adjust the lift thruster motor speed for altitude control. A schematic view of the transmitting and receiver control system is shown in FIG. 3. A microprocessor in the remote controller 38 encodes joystick 39 and potentiometer 42 inputs into an electronic signal which is transmitted out the infrared LED. A battery 98, preferably 9 volt, powers the remote control.

The toy 1 has the appropriate equipment to respond to the signals from the remote controller 38. A photo receiver module 80 converts the infrared light back into an electronic codes signal which a second microprocessor 81 decodes and thereby executes the corresponding the motor actions. A DC/DC voltage step up converter 82 circuit supplies the higher voltage required to run the microprocessor 81 and the photoreceiver module 80. There may be a number of different arrangements for the microprocessor and the remote control system. The methodology of the operation of the infrared remote control is known to those with skill in the art.

In addition to the other features of the toy 1, there is also a switch 48 (FIG. 6) to turn the power off and on, so as to conserve the battery. There may also be an indicator LED light 49 (FIG. 6) which can flash when the power is on.

Other signal systems may be used to control the toy include a ultrasonic signal, radio signals, ultraviolet signals, or any other type of signal. In another embodiment of the invention, a tether may be attached to the toy, with the control signals being sent via an electrical impulse through the tether.

Figure 22:
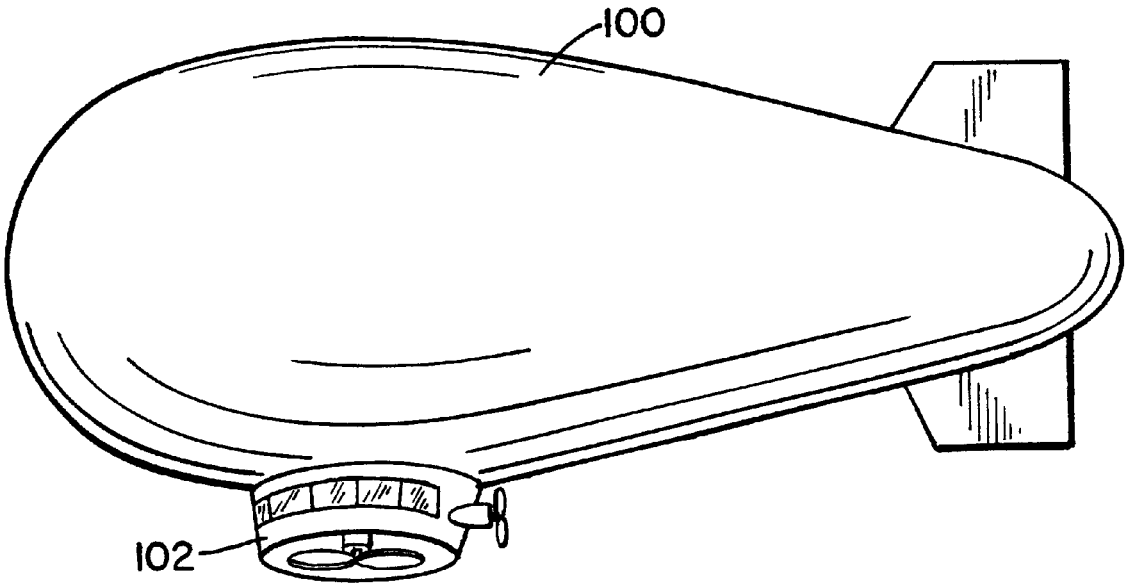
FIG. 22 is a side view of the balloon toy vehicle with the balloon shaped like a dirigible and the body shaped like a dirigible body.

In another embodiment of the invention, depicted in FIG. 22, the balloon is shaped like a dirigible balloon 100, and the body is shaped like the body of a gondola 102 of a dirigible.

Many modifications and variations of the present invention are possible in light of the above teachings. It is, therefore, to be understood within the scope of the appended claims the invention may be protected otherwise than as specifically described.

What is claimed is:

1. A balloon toy vehicle comprising:

a gondola body;

a balloon connected to said gondola body;

a connection for said balloon to connect said balloon to said gondola body;

at least two reversible tandem motors, said motors fixedly positioned at a distal end of the gondola body, said at least two reversible tandem motors having propellers positioned thereon, said propellers rotating on rotating spindles of the motors when the motors are powered on, providing propulsion;

at least one lift thruster motor positioned slightly angularly from a plane formed along the length of the gondola body, and located in a fixed position at the proximal end of the gondola body of said balloon toy vehicle, said at least one lift thruster motor having a thruster propeller positioned thereon, said thruster propeller rotating on a rotating spindle of the at least one lift thruster motor providing lift to said balloon toy vehicle when the at least one lift thruster motor is powered on; and a remote control system for controlling the balloon toy vehicle.

2. The balloon toy vehicle according to claim 1, wherein said remote control system uses a radio signal.

3. The balloon toy vehicle according to claim 1, wherein said remote control system uses an infrared signal.

4. The balloon toy vehicle according to claim 1, further comprising a lift system for picking up or releasing items, said lift system comprising:

a release motor positioned on an underside of said gondola body, said release motor being used to pick up or release items from the balloon toy vehicle;

a bracket supporting said release motor; and a worm screw, said worm screw connected to said release motor, such that when said release motor is powered on, said worm screw rotates causing any item positioned on said worm screw to be released or be positioned and picked up by said system.

5. The balloon toy vehicle according to claim 4, further comprising a lift hoop, said lift hoop having the ability to be picked up or released by said lift system.

6. The balloon toy vehicle according to claim 4, further comprising a guide edge which slopes downward away from the bracket supporting said release motor, said guide edge being positioned on top of said release motor, wherein said guide edge guides the lift hoop down to rest on the worm screw, thereby improving the chances of a successful pick up and release.

7. The balloon toy vehicle according to claim 1, further comprising a battery to power said motors of said balloon toy vehicle, said battery being positioned in said balloon toy vehicle.

8. The balloon toy vehicle according to claim 1, further comprising a balloon mounting assembly connecting the balloon to the gondola body of the balloon toy vehicle, said balloon mounting assembly comprising:

a disk positioned on top of the assembly, wherein a balloon nozzle of a balloon is connected to said disk, a port through which the balloon is filled with helium, a cap for sealing said port, and a shaft for connecting the disk to which the balloon is attached with the gondola body of the toy vehicle.

9. The balloon toy vehicle according to claim 8, further comprising a system for the adjustment of the balloon in relation to the gondola body of the balloon toy vehicle, said vehicle further comprising:

a rotatable joint positioned at a point where the shaft is connected with the gondola body of the toy vehicle, thereby allowing the shaft and balloon assembly to rotate above and in relation to the gondola body of the toy vehicle, and an angular bend in the shaft; such that the rotation of the shaft allows for the repositioning of the balloon in relation to the gondola body, allowing the vehicle to remain approximately horizontal.

10. The balloon toy vehicle according to claim 1, further comprising means to adjust an angular position of the balloon in relation to the gondola body of the toy vehicle, to level the gondola body with respect to a horizon.

11. The balloon toy vehicle according to claim 1, wherein said remote control system comprises:

a) a hand held remote control box for transmitting signals to the motors on the toy vehicle to control the direction and altitude of the gondola body, said hand held remote control device comprising:

i) a joystick to direct the toy vehicle to go forward, backward, left and right up and down;

ii) an adjustable wheel potentiometer to control the lift thruster motor for altitude control;

iii) an infrared emitter at the front of the remote control device; and iv) a microprocessor which encodes the joystick and potentiometer wheel actions into an electronic signal which is transmitted out an infrared LED; and b) the gondola body of the balloon toy vehicle further comprising:

i) a photo receiver module for converting the infrared light back into an electronic signal;

ii) a microprocessor for decoding the electronic signal from the photo receiver module into corresponding motor actions; and iii) a DC/DC step up voltage converter circuit which supplies the voltage needed to run the microprocessor and photo receiver module.

12. The balloon toy vehicle according to claim 1, further comprising at least one pocket in said gondola body of said toy vehicle for at least one ballast weight.

13. The balloon toy vehicle according to claim 1, further comprising a switch to turn the power off or on.

14. A balloon toy vehicle comprising:

a) a gondola body;

b) a balloon connected to said gondola body;

c) a connection for said balloon to connect said balloon to said gondola body;

d) at least two reversible tandem motors, said motors fixedly positioned at a distal end of the gondola body, said at least two reversible tandem motors having propellers positioned thereon, said propellers rotating on rotating spindles of the motors when the motors are powered on, providing propulsion;

e) at least one lift thruster motor, said at least one lift thruster motor located in a fixed position at the proximal end of the gondola body of said balloon toy vehicle, said propeller rotating on a rotating spindle of the at least one lift thruster motor providing lift to said balloon toy vehicle when the at least one lift thruster motor is powered on;

f) a remote control system for controlling the balloon toy vehicle; and g) a lift system for picking up or releasing items, said lift system comprising:

i) a release motor positioned on an underside of said gondola body, said release motor being used to pick up or release items from the balloon toy vehicle;

ii) a bracket supporting said release motor; and iii) a worm screw, said worm screw connected to said release motor, such that when said release motor is powered on, said worm screw rotates causing any item positioned on said worm screw to be released or be positioned and picked up by said system.

15. The balloon toy vehicle according to claim 14, further comprising a lift hoop, said lift hoop having the ability to be picked up or released by said lift system.

16. The balloon toy vehicle according to claim 14, further comprising a guide edge which slopes downward away from the bracket supporting said release motor, said guide edge being positioned on top of said release motor, wherein said guide edge guides the lift hoop down to rest on the worm screw, thereby improving the chances of a successful pick up and release.

17. The balloon toy vehicle according to claim 14, further comprising a balloon mounting assembly connecting the balloon to the gondola body of the balloon toy vehicle, said balloon mounting assembly comprising:

a disk positioned on top of the assembly, wherein a balloon nozzle of a balloon is connected to said disk, a port through which the balloon is filled with helium, a cap for sealing said port, and a shaft for connecting the disk to which the balloon is attached with the gondola body of the toy vehicle.

18. The balloon toy vehicle according to claim 14, further comprising a system for the adjustment of the balloon in relation to the gondola body of the balloon toy vehicle, said vehicle further comprising:

a rotatable joint positioned at a point where the shaft is connected with the gondola body of the toy vehicle, thereby allowing the shaft and balloon assembly to rotate above and in relation to the gondola body of the toy vehicle, and an angular bend in the shaft; such that the rotation of the shaft allows for the repositioning of the balloon in relation to the gondola body, allowing the vehicle to remain approximately horizontal.

* * * * *